US008737886B2

(12) United States Patent
Yoshida

(10) Patent No.: US 8,737,886 B2
(45) Date of Patent: May 27, 2014

(54) IMAGE FORMING APPARATUS AND METHOD

(75) Inventor: Hiroaki Yoshida, Yokohama (JP)

(73) Assignee: Samsung Electronics Co., Ltd., Suwon-Si (KR)

( * ) Notice: Subject to any disclaimer, the term of this patent is extended or adjusted under 35 U.S.C. 154(b) by 87 days.

(21) Appl. No.: 13/330,119

(22) Filed: Dec. 19, 2011

(65) Prior Publication Data

US 2012/0155923 A1 Jun. 21, 2012

(30) Foreign Application Priority Data

Dec. 20, 2010 (JP) ..... 2010-283830
Jul. 12, 2011 (KR) ..... 10-2011-0068970

(51) Int. Cl.
*G03G 15/08* (2006.01)

(52) U.S. Cl.
USPC ..... 399/254; 399/255

(58) Field of Classification Search
USPC ..... 399/254
See application file for complete search history.

(56) References Cited

U.S. PATENT DOCUMENTS 5,697,031 A * 12/1997 Kamiya et al. ..... 399/301
6,122,472 A 9/2000 Sako et al.
6,343,200 B1 * 1/2002 Hatano et al. ..... 399/254
6,526,245 B1 * 2/2003 Yamashita ..... 399/254
2008/0298844 A1 * 12/2008 Katoh et al. ..... 399/254

FOREIGN PATENT DOCUMENTS

| | | |
|---|---|---|
| JP | 5-297714 | 11/1993 |
| JP | 7-199628 | 8/1995 |
| JP | 8-22180 | 1/1996 |
| JP | 9-325612 | 12/1997 |
| JP | 10-3219 | 1/1998 |
| JP | 10-142916 | 5/1998 |
| JP | 11-84839 | 3/1999 |
| JP | 11-84840 | 3/1999 |
| JP | 11-143192 | 5/1999 |
| JP | 2001-109264 | 4/2001 |
| JP | 2003-5519 | 1/2003 |
| JP | 2006-323238 | 11/2006 |

* cited by examiner

*Primary Examiner* — Clayton E Laballe
*Assistant Examiner* — Jas Sanghera
(74) *Attorney, Agent, or Firm* — Staas & Halsey LLP

(57) ABSTRACT

An image forming apparatus that may securely mix a toner and a carrier in a minimum space when high-speed printing is performed. The image forming apparatus including: a photosensitive drum; a developing roller; and a developing unit, wherein the developing unit includes: a receiving or transferring unit for receiving or transferring a two-component developing agent in an axial direction of a developing roller; and a preparatory agitation unit disposed on an end part of the receiving or transferring unit and including an agitation screw that has a large diameter and for mixing the newly-supplied toner and the carrier.

7 Claims, 13 Drawing Sheets

| | | CONDITION 1 | CONDITION 2 | CONDITION 3 | |
|---|---|---|---|---|---|
| V | MAIN VELOCITY OF PHOTOSENSITIVE BODY | 161 | 380 | 300 | mm/s |
| L | DEVELOPING WIDTH | 294 | 210 | 210 | mm |
| ΔCt | TONER CONCENTRATION DIFFERENCE | 1.0 | 1.0 | 1.0 | % |
| M/A | AMOUNT OF TONER ATTACHED TO PHOTOSENSITIVE BODY | 6.0E-06 | 6.0E-06 | 6.0E-06 | $g/mm^2$ |

| | | CONDITION 1 | CONDITION 2 | CONDITION 3 | |
|---|---|---|---|---|---|
| W | AMOUNT OF TRANSFERRING DEVELOPING AGENT | 28 | 47 | 37 | g/s |

FIG. 10

| | | CONDITION 1 | CONDITION 2 | CONDITION 3 | |
|---|---|---|---|---|---|
| m | AMOUNT OF DEVELOPING AGENT | 350 | 200 | 200 | g |
| T1 | TIME REQUIRED AT WHICH DEVELOPING AGENT FLOWS AROUND DEVELOPING UNIT IN ONE CYCLE | 12.5 | 4.3 | 5.4 | s |
| T2 | TIME FOR MIXTURE AND AGITATION | 6.25 | 2.1 | 2.7 | s |

IMAGE FORMING APPARATUS AND METHOD

CROSS-REFERENCE TO RELATED APPLICATIONS

This application claims the priority benefit of Japanese Patent Application No. 2010-283830, filed on Dec. 20, 2010, in the Japan Patent Office and Korean Patent Application No. 10-2011-0068970, filed on Jul. 12, 2011, in the Korean Intellectual Property Office, the disclosures of which are incorporated herein in their entireties by reference.

BACKGROUND

1. Field

Example embodiments of the following description relate to an image forming apparatus and method, and more specifically, an image forming apparatus and method that may securely mix a toner and a carrier in a minimum space when high-speed printing is performed.

2. Description of the Related Art

Image forming apparatuses using electrophotography, such as laser printers, laser fax machines, or digital copiers, charge a photosensitive drum and expose the photosensitive drum to thus form an electrostatic latent image in accordance with an image signal. Then, the image forming apparatus supplies a toner charged by a developing unit to the photosensitive drum to develop the electrostatic latent image, transfer the developed image onto a printing medium, such as a paper, and fuse the image by using a fusing unit, thereby forming an image.

It is well known that, in image forming apparatuses, a magnet roller is used for supplying a toner to the photosensitive drum. For example, Japanese Patent Application Publication No. hei 10-142916 and Japanese Patent Application Publication No. 2006-323238 that are described as prior art references in the background of the disclosure disclose an apparatus using a two-component developing agent containing a toner and a carrier. Also, Japanese Patent Application Publication No. hei 10-142916 discloses a configuration for supplying a toner by mixing the toner in a developing agent.

The processing capability of image forming apparatuses has recently increased, and thus, the number of pages that can be printed per unit time has greatly increased. Thus, in apparatuses using a two-component developing agent, the amount of consumed toner is continually supplemented, and simultaneously, the supplemented toner and carrier need to be mixed within a short time.

However, in image forming apparatuses according to the related arts described above, high-speed printing is not considered. Thus, when the amount of consumed toner is supplemented and is supplied, the toner and the carrier may not be sufficiently mixed due to high-speed printing.

In particular, the demand for relatively small image forming apparatuses that print A4 paper is increasing. In such small image forming apparatuses, the length of a path in which the toner is received or transferred, is also decreased. Thus, a distance at which the toner and the carrier are agitated is also decreased, so that a toner/carrier mixture is insufficient.

When the toner/carrier mixture is insufficient, the toner friction charges the carrier, and the toner having an appropriate polarity and an appropriate amount of charge cannot be controlled. Thus, the quality of an image may be lowered due to the toner having an opposite polarity and a small amount of charge.

In addition, the amount of a developing agent is decreasing as the size of image forming apparatuses is reduced. In particular, for low cost per page and for enhancing quality of a printed image, the concentration of an image can be maintained only with a small amount of developing agent by adding a strong pigment to the toner and decreasing the diameter of the carrier. However, in systems using a two-component developing agent, the amount of consumed toner is precisely measured, is injected into the carrier, is agitated, charged, and dispersed. To this end, an agitation time is required. When the agitation time is short, the toner is not sufficiently charged and is not deposited on the surface of the carrier and is received or transferred from/to a developing region.

In addition, the developing agent uses powder that is coated with resin on the surface of ferrite or magnetite, and the toner of which a main ingredient is resin is mixed with the powder. Thus, when the toner is mixed in the flow of the developing agent, there is a difference in specific gravity between the toner and the developing agent and the toner is not smoothly mixed with the flow of the developing agent. Thus, the toner may be received or transferred from/to the developing region with insufficient charge and dispersion. Basically, the toner having an appropriate polarity and an appropriate amount of charge needs to be controlled. When charge/dispersion is insufficient, the toner can have an opposite polarity and the amount of charge of the toner can be lowered. Thus, the toner attaches to a region of a photosensitive drum to which the toner is not to attach, thus deteriorating the quality of an image (background pollution of the image is increased) and image contamination occurs. In addition, when the amount of charge of the toner is insufficient, contamination may occur in the developing unit. In particular, in the case of a high-speed developing unit for A4 paper, the agitation time is 25% shorter than in a developing unit for A3 paper. Thus, there is a limitation in realizing a high speed in general developing units.

SUMMARY

Additional aspects and/or advantages will be set forth in part in the description which follows and, in part, will be apparent from the description, or may be learned by practice of the disclosure.

The present disclosure provides an image forming apparatus that may securely mix a toner and a carrier in a minimum space when high-speed printing is performed.

According to an aspect of the present disclosure, there is provided an image forming apparatus including: a photosensitive drum for transferring a toner supplied according to an electrostatic latent image onto a printing medium and for forming an image on the printing medium; a developing roller for supplying the toner to the photosensitive drum; and a developing unit for supplying, to the developing roller, a two-component developing agent in which the toner and a carrier are mixed. Further, the developing unit includes: a transferring unit for transferring the two-component developing agent, in an axial direction of the developing roller; and a preparatory agitation unit disposed on an end part of the transferring unit, including an agitation screw that has a large diameter for mixing the newly-supplied toner and the carrier. When a process speed at which the photosensitive drum forms an image on the printing medium is approximately 300 mm/s, a width of the printing medium at which the photosensitive drum forms an image is equal to or less than approximately 216 mm. If an amount at which the agitation screw protrudes from a surface of the two-component developing agent in an upward direction is r [mm], a pitch of the agitation screw is P[mm], the number of revolutions of the agitation screw is R [rps], and time for mixture and agitation is T [s], then the preparatory agitation unit may satisfy the following inequality:

$$r > 20\frac{P}{RT}.$$

When an outer diameter of the photosensitive drum is equal to or less than approximately 30 mm, a cross-sectional area of the preparatory agitation unit is S1 [$mm^2$], a cross-sectional area of the photosensitive drum is S2 [$mm^2$], a cross-sectional area of the developing roller is S3 [$mm^2$], and a cross-sectional area of a transferring screw of the transferring unit is S4 [$mm^2$], the following inequality may be satisfied:

$$S1 < S2 + S3 + S4.$$

An outer diameter of the photosensitive drum may be equal to or less than approximately 30 mm, and a cross-sectional area of a cross-section that is perpendicular to an axis of the photosensitive drum of a processing unit including the photosensitive drum, the developing roller, and the developing unit may be equal to or less than approximately 3500 $mm^2$.

An outer diameter of the photosensitive drum may be equal to or less than approximately 30 mm. Additionally, a width of a cross-section that is perpendicular to an axis of the photosensitive drum of a processing unit, including the photosensitive drum, the developing roller, and the developing unit may be equal to or less than approximately 70 mm.

According to an aspect of the present disclosure, provided is an image forming method for securely mixing a two-component developing agent during high-speed printing, the method including: performing preparatory agitation to mix a toner and a carrier, the toner and the carrier together comprising the two-component developing agent; and transferring the two-component developing agent to a developing roller, wherein, in performing the preparatory agitation, configuring a preparatory agitation unit to have a large diameter so that newly-supplied toner is fully mixed with a carrier and the newly-supplied toner is charged to a predetermined potential.

According to an aspect of the present disclosure, provided is an image forming apparatus, the apparatus including a photosensitive drum to transfer a toner supplied according to an electrostatic latent image onto a printing medium, and to form an image on the printing medium; a developing roller to supply the toner to the photosensitive drum; and a developing unit to supply, to the developing roller, a two-component developing agent, in which the toner and a carrier are mixed, wherein the developing unit further comprises a preparatory agitation unit to perform agitation of newly-supplied toner with the carrier, and to securely charge the newly-supplied toner to a negative potential, and wherein the preparatory agitation unit has a larger diameter than the photosensitive drum and the developing roller, individually.

BRIEF DESCRIPTION OF THE DRAWINGS

The above and other features and advantages of the present disclosure will become more apparent by describing in detail exemplary embodiments thereof with reference to the attached drawings in which:

FIG. 10 is a table showing the amount m of a developing agent, the time T1 at which the developing agent flows around a developing unit in one cycle, and the time T2 for mixture and agitation according to each of conditions 1, 2, and 3;

DETAILED DESCRIPTION

Figure 1:
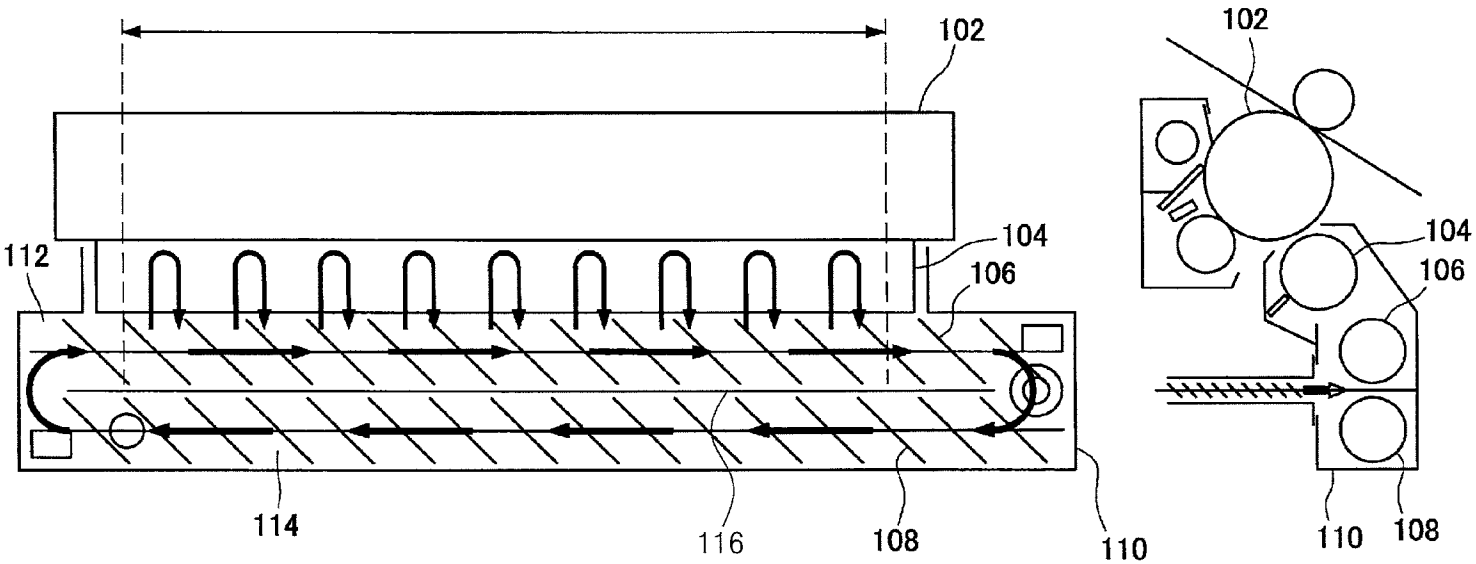
FIG. 1 is a schematic view of an image forming apparatus, according to the related art.

The present disclosure will now be described more fully with reference to the accompanying drawings, in which exemplary embodiments of the disclosure are shown. The disclosure may, however, be embodied in many different forms and should not be construed as being limited to the embodiments set forth herein; rather, these embodiments are provided so that this disclosure will be thorough and complete, and will fully convey the concept of the disclosure to those skilled in the art. In the drawings, the thicknesses of layers and regions are exaggerated for clarity.

FIG. 1 is a schematic view of an image forming apparatus according to the related art.

Referring to FIG. 1, the image forming apparatus according to the related art uses a two-component developing agent containing a toner and a carrier. The image forming apparatus includes a developing roller 104 that accommodates a developing agent and supplies the toner to a photosensitive drum 102, first and second agitation screws 106 and 108 that agitate the developing agent and charges toner particles by friction, and a developing case 110 in which the developing agent is accommodated and is stored.

A developing agent prepared by mixing the toner and the carrier is used in a developing unit using a two-component developing agent. Only the toner is consumed in a developing region, and the carrier is re-used. In order to supply the consumed toner, the amount of previously-printed toner is measured by bit count, etc., and is predicted so that a shortage detected by a toner concentration sensor may be supplied. As an image forming apparatus has been recently digitalized, an image is formed using a digital exposure device, such as a laser scanner or a light-emitting diode (LED) head. Thus, the amount of drawing may be checked and calculated digitally, and the amount of toner consumption according to time may be predicted and supplied. The actual amount of toner consumption is changed according to the environment or a situation of an electrophotographic member. In addition, because a toner supply unit is also a mechanical part, the amount of toner supply is changed due to a difference in mechanical dimensions of the toner supply unit. Thus, the amount of toner supply may be checked and supplied by using the toner concentration sensor, etc.

The toner supply unit supplies the toner quantitatively, and thus, a supply roller of a sponge or a shaft, having a cut groove, passes through a narrow gap. The supplied toner is condensed with secondary particles and is injected into the developing agent in the developing unit. The injected toner particles contact the surface of the carrier of the developing agent, are charged, and are attached to the surface of the carrier. In this process, the toner is properly charged and is deposited on the surface of the carrier of the developing agent. The injected toner particles may be developed in this state. An agitation unit injects the toner into the developing agent circulatively by using an agitation screw, as illustrated in FIG. 1, for example, to mix and agitate the toner, and disperses and charges the toner so that the toner is transferred to the developing region of the developing roller 104.

In FIG. 1, the developing case 110 includes first and second agitation chambers 112 and 114, in which the first and second agitation screws 106 and 108 are installed, and the first agitation chamber 112 is adjacent to the developing roller 104, so that the developing agent may contact the developing roller 104.

In the developing case 110, in order to circulate the developing agent between the first and second agitation chambers 112 and 114, a partition wall 116 is disposed between the first and second agitation chambers 112 and 114 to define a path, in which the developing agent is received from the first agitation chamber 112 and is transferred to the second agitation chamber 114, and a path, in which the developing agent is received from the second agitation chamber 114 and is transferred to the first agitation chamber 112.

However, because an image forming apparatus, such as a printer, operates faster, a high-speed image forming apparatus, having a process speed higher than 300 mm/s is available. In addition, the size of the image forming apparatus has been reduced by demand, such as a change from an image forming apparatus for A3 paper to A4 paper (letter size), a change from a three-axes configuration including a paddle to a two-axes spiral agitation screw, a reduction in the weight of a developing agent used in a developing unit (i.e., half reduction from 400 g to 200 g), and the like.

The toner is agitated in a more limited space at higher speeds, which is a limitation in a two-axes developing unit illustrated in FIG. 1. Thus, in the current embodiment, preparatory agitation is performed to smoothly perform toner mixture and agitation. By using preparatory agitation, the effect of an outer diameter of the two-axes spiral agitation screw on a layout is reduced, and thus, the outer diameter of the two-axes spiral agitation screw may be remarkably smaller than an outer diameter of the developing roller 104.

Figure 2:
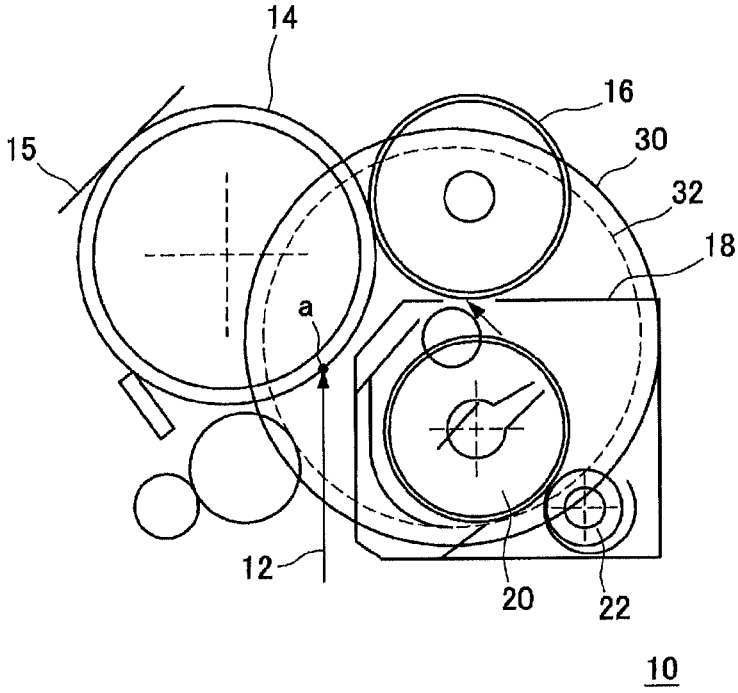
FIG. 2 is a schematic view of an image forming apparatus, according to an example embodiment.

FIG. 2 is a schematic view of an image forming apparatus 10 from an axial direction of a developing roller 16, according to an embodiment of the present disclosure. The image forming apparatus 10 according to the present embodiment scans and exposes a laser beam 12 that is modulated in response to an image signal onto a photosensitive drum 14, thereby printing on a printing medium 15, such as a paper or plastic sheet, by using dry electrophotography. The image forming apparatus 10 may be a laser printer, a laser fax machine, a digital copier, and the like, or may be a part thereof. The image forming apparatus 10 performs a printing operation, and the like, by using a two-component developing agent containing a toner and a carrier.

Referring to FIG. 2, the image forming apparatus 10 includes a laser exposure unit (not shown). The laser exposure unit (not shown) scans the laser beam 12 focused as a small spot at an exposure position a of the photosensitive drum 14 in a predetermined direction of a straight line that is parallel to a rotation axis of the photosensitive drum 14. When the laser beam 12 is scanned onto the surface of the photosensitive drum 14, the exposure portion of the photosensitive drum 14 has a positive potential with respect to a non-exposure portion thereof.

The developing roller 16 is disposed on a downstream side of the exposure position a of the photosensitive drum 14. In addition, a developing unit 18 is adjacent to the developing roller 16. A two-component developing agent C (FIG. 3) containing a toner and a carrier is stored in the developing unit 18. The two-component developing agent C in the developing unit 18 is moved in an axial direction of the developing roller 16 by a first transferring screw 20 in the developing unit 18 and attaches to the surface of the developing roller 16 by a magnetic force of the developing roller 16. The toner of the two-component developing agent C, which is supplied to the developing roller 16 that is charged to a negative potential, is supplied to the surface of the photosensitive drum 14 from the developing roller 16 due to a potential difference between the toner and the carrier of the two-component developing agent C. The carrier of the two-component developing agent C is recovered in the developing unit 18 from the surface of the developing roller 16.

The two-component developing agent C containing a powder toner having a predetermined color and a metal powder carrier is stored in the developing unit 18. For example, the powder toner is formed by adding a pigment, a charge control agent (CCA), polymethyl methacrylate (PMMA), and the like to polyester particles having a diameter of about 7-8 μm. In addition, for example, the carrier is formed by coating silicon on ferrite particles having a diameter of about 35-60 nm.

In addition, a permeability sensor (not shown) is disposed in the developing unit 18, and the amount of toner supply to the developing unit 18 is adjusted so that the weight percentage of the toner with respect to a total weight of the two-component developing agent C has a predetermined value.

Figure 3:
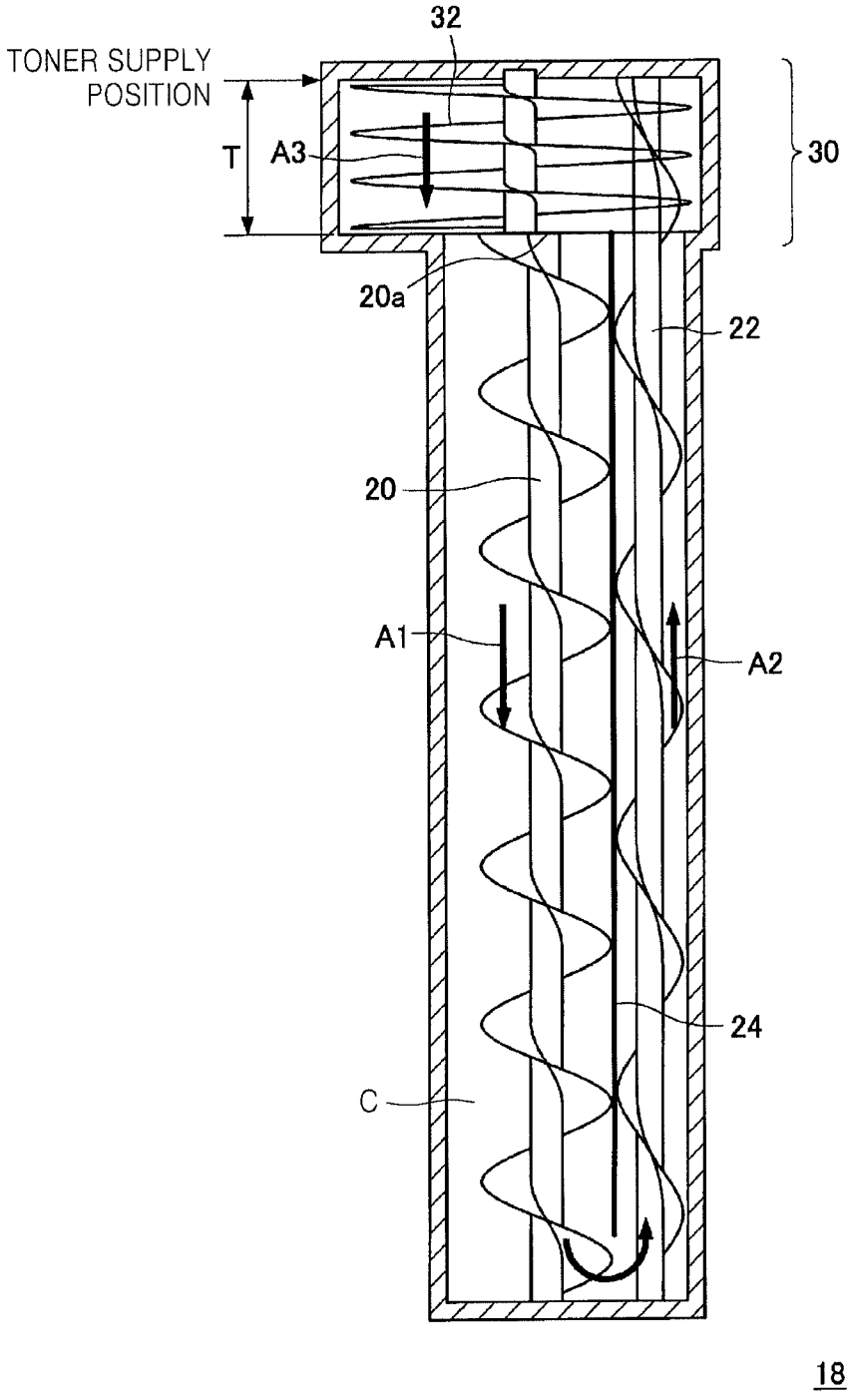
FIG. 3 is a view of a developing unit in an upward direction of FIG. 2, according to an example embodiment.

FIG. 3 is a view of the developing unit 18 in an upward direction of FIG. 2.

Referring to FIG. 3, the first transferring screw 20 that transfers the two-component developing agent C in an axial direction (a direction A1) of the developing roller 16 is disposed in the developing unit 18. In addition, a second transferring screw 22 is disposed in the developing unit 18 to be parallel to the first transferring screw 20, and a partitioning wall 24 is interposed between the first and second transferring screws 20 and 22. The two-component developing agent C to be supplied to the developing roller 16 is transferred in the direction A1 by first transferring screw 20, enters from a path formed by an edge of the partitioning wall 24 to a transferring chamber in which the second transferring screw 22 is installed, and is transferred in a direction A2 by the second transferring screw 22.

When the two-component developing agent C is agitated in the developing unit 18, the toner is charged to a negative potential and the carrier is charged to a positive potential. In this case, the amount of toner charging is about −25 to −15 μC/g, for example. Thus, the toner that is charged to the negative potential attaches to the surface of the carrier that is charged to the positive potential. In this case, when the weight percentage of the toner stored in the developing unit 18 is about 6 to 10%, the toner attaches to about 60-80% of the surface area of the carrier.

The carrier to which the toner is attached is transferred in the direction A1 by using the first transferring screw 20 and is sent to the surface of the developing roller 16. Then, the carrier to which the toner is attached attaches to the surface of the developing roller 16 due to a magnetic force of the developing roller 16.

Next, the preparatory agitation unit 30 of the developing roller 18 will be described. As illustrated in FIG. 3, the preparatory agitation unit 30 is disposed on an end of the developing unit 18. An agitation screw 32 is disposed in the preparatory agitation unit 30. As illustrated in FIG. 2, the preparatory agitation unit 30 has a larger diameter than those of the photosensitive drum 14, the developing roller 16, the first transferring screw 20, and the second transferring screw 22. The preparatory agitation unit 30 is connected to the developing unit 18 including the first and second transferring screws 20 and 22 disposed therein via a transferring path formed in the agitation unit. The two-component developing agent C that is mixed by the preparatory agitation unit 30 is supplied to a position of an end part 20*a* of the first transferring screw 20 from the transferring path and is transferred by using the first transferring screw 20.

As described above, the carrier to which the toner is attached is transferred in the direction A1 by using the first transferring screw 20 and is sent to the surface of the developing roller 16 and then is transferred in the direction A2, as illustrated in FIG. 3. Thus, the weight percentage of the toner with respect to a total weight of the two-component developing agent C that is transferred by using the second transferring or receiving screw 22 is decreased. Thus, the two-component developing agent C that has the decreased weight percentage of the toner is sent to the preparatory agitation unit 30 by using the second transferring screw 22, and then, a toner is newly supplied to the preparatory agitation unit 30.

As illustrated in FIG. 3, the toner is newly supplied to an end part of the preparatory agitation unit 30. The two-component developing agent C that is supplied to the preparatory agitation unit 30, using the second transferring screw 22, is mixed with the toner, which is newly supplied due to rotation of the agitation screw 32, and is sent to an internal space of the preparatory agitation unit 30 in a direction A3. In the present embodiment, the toner that is newly supplied to the internal space of the preparatory agitation unit 30 attaches to the carrier in the preparatory agitation unit 30, is charged to a negative potential, and is sent to a position of the end part 20*a* of the first transferring screw 20. The two-component developing agent C that is sent to the position of the end part 20*a* of the first transferring screw 20 is sent in the direction A1 by using the first transferring screw 20 and is supplied to the developing roller 16.

In this manner, in the current embodiment, the preparatory agitation unit 30 is configured to have a large diameter so that the newly-supplied toner may be fully mixed with the carrier in the preparatory agitation unit 30 and may be charged to a predetermined potential.

Thus, in the current embodiment, for time T from the time when the toner is supplied in a toner supply position in FIG. 2 to the time when the toner reaches the position of the end part 20*a* of the first transferring screw 20 (hereinafter, referred to as time for mixture and agitation), toner/carrier mixing may be performed and the toner may be charged to the negative potential.

Thus, when the two-component developing agent C is transferred by using the first transferring screw 20, the toner has already been charged to a negative potential. Thus, the toner that is charged to the positive potential may be securely prevented from being supplied to the developing roller 16.

In the current embodiment, the preparatory agitation unit 30 that has a large diameter is disposed on a lateral part of the agitation unit. By using this structure, compared to a case where mixing is performed using the first and second agitation screws 106 and 108 that have a small cross-sectional area illustrated in FIG. 1, the newly-supplied toner and carrier may be securely mixed together. By performing only agitation using the preparatory agitation unit 30, the toner may be securely charged to the negative potential.

In order to perform agitation by using the preparatory agitation unit 30, in the current embodiment, a predetermined relationship between the amount of two-component developing agent C in the preparatory agitation unit 30 (including the newly-supplied toner), a pitch P of the agitation screw 32, revolutions per minute (rpm) R of the agitation screw 32, and the time T for mixture and agitation is established.

Hereinafter, the relationship therebetween will be described in detail.

Figures 4, 5:
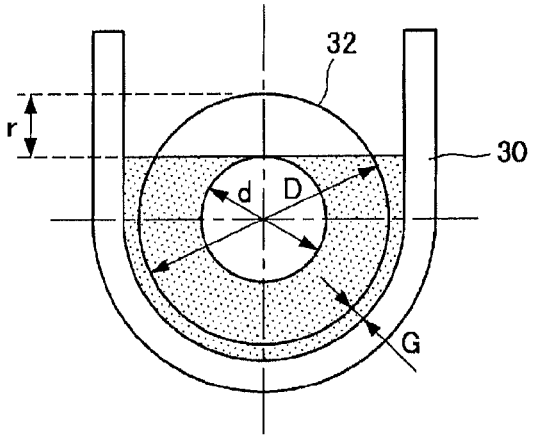
FIG. 4 is a view of a preparatory agitation unit, according to an example embodiment.
FIG. 5 is a table showing a condition of an image forming apparatus according to the related art and two conditions of an image forming apparatus illustrated in FIG. 2.

FIG. 4 is a view of a structure of the preparatory agitation unit 30 from an axial direction of the agitation screw 32. As illustrated in FIG. 4, the agitation screw 32 is disposed in the preparatory agitation unit 30. As illustrated in FIG. 4, in the current embodiment, a distance r between an outer diameter of the agitation screw 32 and the surface of the two-component developing agent C in the preparatory agitation unit 30 is obtained so that the agitation screw 32 is not fully buried in the preparatory agitation unit 30 by the two-component developing agent C (including the newly-supplied toner).

Sato, Kimura, Japanese Image Association, published in 2002, Volume 41, Issue No. 1, pages 34~39, discloses a study on image concentration uniformity in two-component magnetic brush screw developing by using an auger that is a two-axes spiral agitation screw illustrated in FIG. 1, which shows the relationship (Equation 1 below) between a toner concentration difference ΔCt of a developing agent and the amount W of transferring the developing agent on both ends of a magnetic roller (corresponding to the developing roller 18 according to the current embodiment). Here, the amount W of transferring the developing agent is the amount of developing agent (g/s) that is transferred by the developing unit for a predetermined amount of time. In addition, Equation 2 below represents the relationship between the amount W of transferring the developing agent, a cross-sectional area S of the transferred developing agent, a pitch P of a screw, and the number of revolutions R of the screw. In addition, Equation 3 below is used to calculate the cross-sectional area S of the developing agent in FIG. 4 (the area of a dotted region in FIG. 4).

$$\Delta Ct=(M/A)*V*L/W \quad \text{Equation 1}$$

$$W=\eta*\rho*S*P*R \quad \text{Equation 2}$$

$$S=\pi*(D/2+G)^2/2+(D+2*G)*d-\pi*(d/2)^2 \quad \text{Equation 3}$$

In the above Equations 1, 2, and 3,

P: pitch of screw

R: the number of revolutions of screw

D: outer diameter of screw d: axial diameter of screw

G: distance between screw and casing (see FIG. 4)

ΔCt: toner concentration difference

M/A: the amount of toner attached to photosensitive body (photosensitive drum 14)

V: main velocity of photosensitive body (photosensitive drum 14)

L: developing width (effective lengths of developing roller 16 and photosensitive drum 14)

W: the amount of transferring developing agent

η: transferring efficiency

ρ: bulk density of developing agent

S: cross-sectional area of transferred developing agent

It may be known from Equation 1 that the toner concentration difference ΔCt may be reduced as the amount W of transferring the developing agent increases.

FIG. 5 is a table showing a condition of an image forming apparatus according to the related art and two conditions of the image forming apparatus 10 illustrated in FIG. 2.

Referring to FIG. 5, condition 1 represents a general condition in which speed-up of about 300 mm/s is not considered and a process speed (main velocity V of photosensitive body) is about 161 mm/s. Conditions 2 and 3 are conditions of the image forming apparatus 10 illustrated in FIG. 2 in which the process speed over 300 mm/s is considered. In addition, in condition 1, a printing medium 15 having a size of A3 paper is considered, and a developing width is 294 mm, which is a relatively larger value. In conditions 2 and 3, a printing medium 15 having a size of A4 paper (or letter size) is considered, and a developing width is 210 mm, which is a relatively smaller value.

As the process speed increases, the newly-supplied toner and carrier need to be mixed together at higher speeds. In addition, as illustrated in FIG. 1, when the developing width decreases, a distance at which the toner and the carrier are agitated by the first and second agitation screws 106 and 108 is decreased so that the toner/carrier mixture is not efficiently performed. As illustrated in FIG. 5, the toner concentration difference ΔCt regardless of conditions 1 to 3 is less than 1%. When the toner concentration difference ΔCt of the developing agent on both ends of the magnetic roller exceeds 1%, a concentration difference at both ends of the paper increases. In the current embodiment, a cause for the concentration difference is removed by installing the preparatory agitation unit 30 that has a large diameter. The relationship between the toner concentration difference ΔCt and the amount W of transferring the developing agent of the developing unit 18 is obtained from Equation 1.

Figures 6, 7:
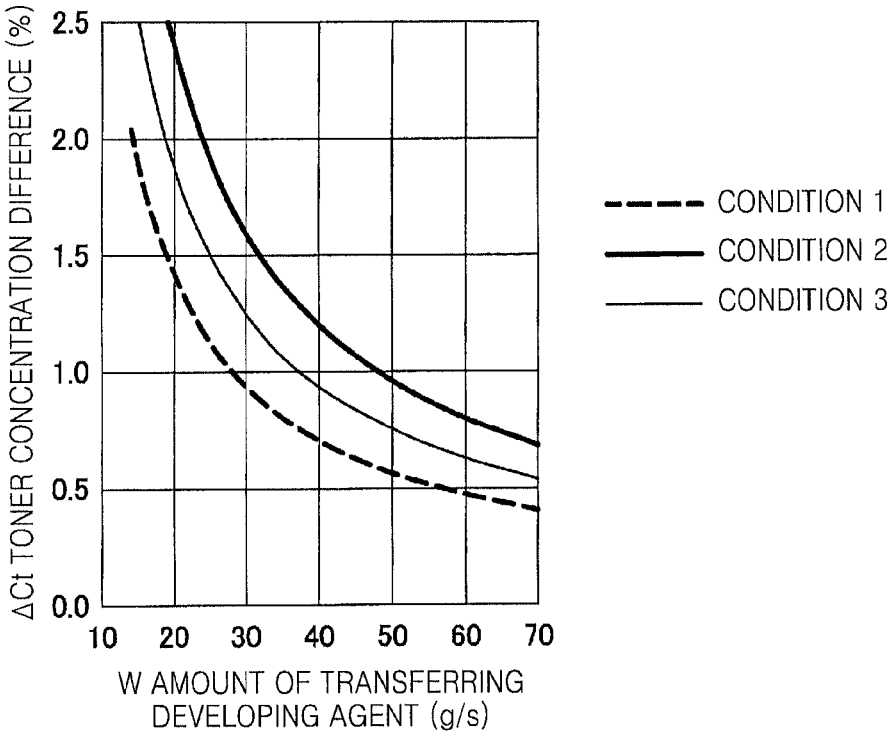
FIG. 6 is a graph showing the relationship between a toner concentration difference ΔCt of a magnetic roller and the amount W of transferring a developing agent in Equation 1.
FIG. 7 is a table showing the amount W of transferring a developing agent for setting a toner concentration difference ΔCt according to each of the conditions 1, 2, and 3 illustrated in FIG. 6 to be less than 1%.

FIG. 6 is a graph showing the relationship between a toner concentration difference ΔCt of a magnetic roller and the amount W of transferring a developing agent in Equation 1. When the toner concentration difference ΔCt exceeds 1.0%, a concentration difference in the printing medium 15 is recognized, and thus, the toner concentration difference ΔCt is targeted at a value that is equal to or less than 1.0%. FIG. 6 illustrates the relationship between the toner concentration difference ΔCt and the amount W of transferring the developing agent on each of conditions 1, 2, and 3, shown in FIG. 5. As illustrated in FIG. 6, as the amount W of transferring the developing agent increases, the toner and the carrier may be efficiently mixed together so that the toner concentration difference ΔCt is reduced.

FIG. 7 is a table showing the amount of transferring a developing agent W for setting a toner concentration difference ΔCt according to each of the conditions 1, 2, and 3 illustrated in FIG. 6 to be less than 1%.

Referring to FIG. 7, in order to set the toner concentration difference ΔCt to be less than 1%, in the case of condition 1, the amount W of transferring the developing agent is to be less than approximately 28 g/s. In the case of condition 2, the amount W of transferring the developing agent is to be less than approximately 47 g/s. In the case of condition 3, the amount W of transferring the developing agent is to be less than approximately 37 g/s.

The number of revolutions R of the screw that transfers the developing agent may be approximately 500 rpm in consideration of a temperature rise of a bearing unit, stress on the developing agent, and the like. In this case, the number of revolutions R of the screw may be 500 rpm. The value of the amount W of transferring the developing agent is obtained from each of conditions 1 to 3, and when R is 500 rpm, the relationship between the cross-sectional area S of the transferred developing agent and the pitch P of the screw may be obtained from Equation 2.

Figure 8:
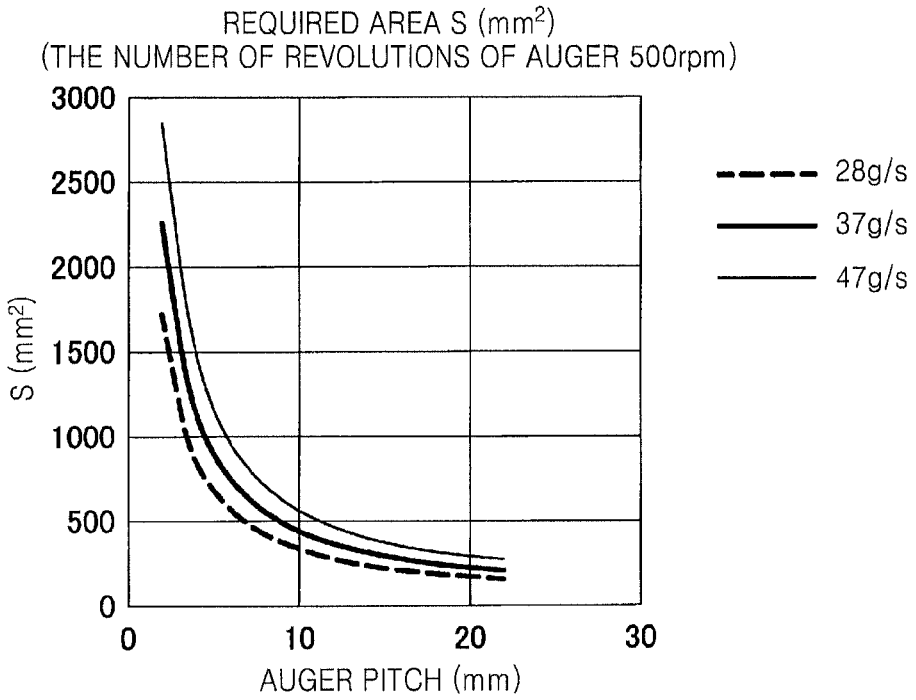
FIG. 8 is a graph showing the relationship between an area S and a pitch P of a screw according to each of conditions 1, 2, and 3.

FIG. 8 is a graph showing the relationship between an area S and a pitch P of a screw according to each of conditions 1 (W=28 g/s), 2 (W=47 g/s), and 3 (W=37 g/s). The number of revolutions of the screw is 500 rpm. As the area S of the screw increases and the pitch P of the screw increases, the amount W of transferring the developing agent increases.

However, the lower limit of an inner diameter of the screw needs to be approximately 6 mm in view of strength of the screw. Thus, the inner diameter of the screw is 6 mm (minimum). In addition, because a gap G between the screw and a housing is a gap between which the screw and the housing do not contact each other within a tolerance, the gap G is set to approximately 1 mm. Thus, Equation 3 is introduced in regard to the result of FIG. 8 so that the relationship between the outer diameter D of the screw and the pitch P of the screw may be obtained.

Figure 9:
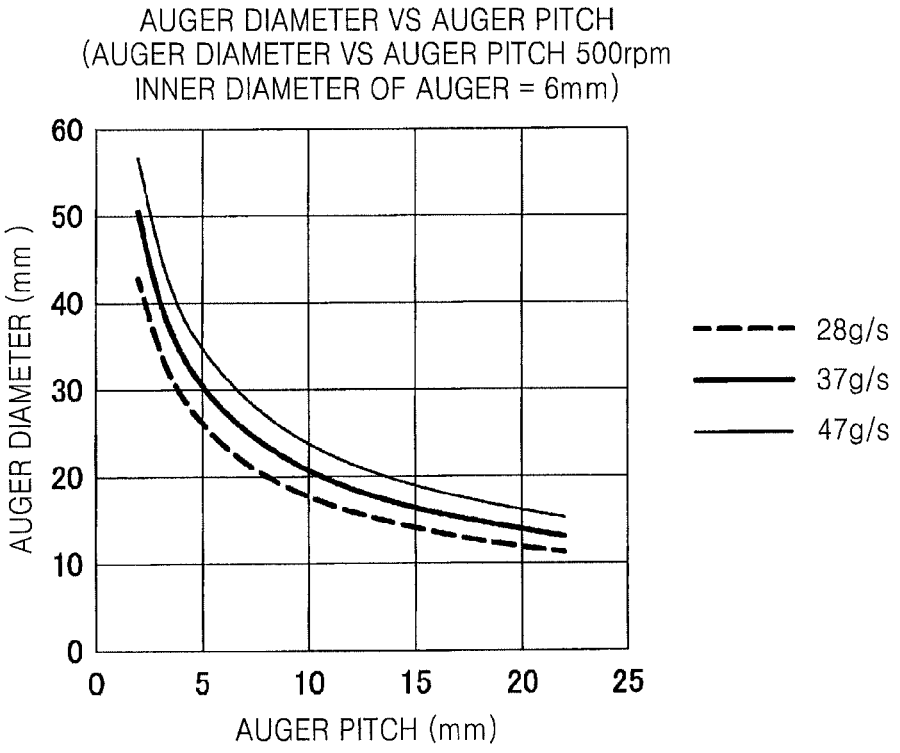
FIG. 9 is a graph showing the relationship between an outer diameter D and a pitch P of a screw according to each of conditions 1, 2, and 3.

FIG. 9 is a graph showing the relationship between an outer diameter D and a pitch P of a screw according to each of conditions 1 (W=28 g/s), 2 (W=47 g/s), and 3 (W=37 g/s).

As illustrated in FIG. 9, as the outer diameter D of the agitation screw 32 increases and the pitch P of the screw 32 increases, the amount W of transferring the developing agent increases. Thus, in the current embodiment, the agitation screw 32 of the preparatory agitation unit 30 has a large diameter so that the amount W of transferring the developing agent may be increased and thus, the toner concentration difference Δt may be decreased. For example, referring to FIG. 9, in order to obtain the amount of transferring the developing agent (W=37 g/s), the outer diameter D of the agitation screw 32 may be 400 mm and the pitch P thereof may be 3 mm.

On the other hand, as described above, the amount m of the developing agent that exits in the developing unit 18 has a tendency to be small so as to reduce the size of the developing unit 18, and thus, is about 350 g according to the related art but is about 200 g in the current embodiment. In addition, when two screws circulate the developing agent in the developing unit 18, the time for the developing agent to flow around the developing unit 18 in one cycle, and the time for mixture and agitation using a two-axes spiral agitation screw may be obtained from the amount m of the developing agent in the developing unit 18 and the amount W of transferring the developing agent to obtain.

FIG. 10 is a table showing the amount m of a developing agent, the time T1 at which the developing agent flows around the developing unit 18 in one cycle, and the time T2 for mixture and agitation according to each of conditions 1 (W=28 g/s), 2 (W=47 g/s), and 3 (W=37 g/s).

As illustrated in FIG. 10, in the current embodiment, the amount m of the developing agent in the developing unit 18 according to conditions 2 and 3 is approximately 200 g. The amount m of the developing agent according to a general condition 1 is approximately 350 g. Time T1 for the developing agent to flow around the developing unit 18 in one cycle may be calculated by dividing the amount m of the developing agent by the amount W of transferring the developing agent (g/s). In addition, the time T2 for mixture and agitation is half of the time T1 for the developing agent to flow around the developing unit 18 in one cycle.

As illustrated in FIG. 10, in the current embodiment (conditions 2 and 3), the time T2 for mixture and agitation is about half to one third of mixture and agitation according to the related art (condition 1). Thus, when the preparatory agitation unit 30 that uses a large-diameter screw is installed, the size of the developing unit 18 is the same as that of a general developing unit so that the toner concentration difference ΔCt may be reduced to a minimum value and the time T2 for mixture and agitation may be reduced.

Figure 11:
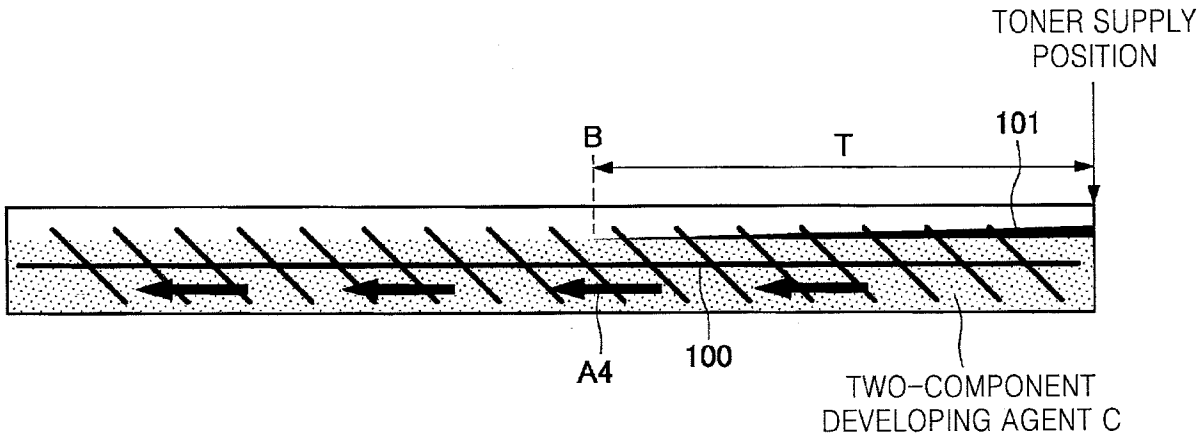
FIG. 11 is a view for explaining the time T for mixture and agitation.

FIG. 11 is a view for explaining the time T for mixture and agitation illustrated in FIG. 3 in more detail. In FIG. 11, when the two-component developing agent C is transferred in a direction A4 and agitated by an agitation screw 100, the toner 110 supplied in a toner supply position of FIG. 11 is mixed with the two-component developing agent C.

As illustrated in FIG. 11, because, when a toner 101 is newly supplied to the toner supply position, the specific gravity of the toner 101 is less than that of the two-component developing agent C, the toner 101 immediately after being supplied is not mixed with the two-component developing agent C but is stacked on the two-component developing agent C. Thereafter, when the toner 101 and the two-component developing agent C are transferred in the direction A4, as time elapses, the toner 101 is mixed with the two-component developing agent C and attaches to the carrier of the two-component developing agent C. Thus, because the toner 101 is closer to the left side of FIG. 11, the thickness of the toner 101 on the two-component developing agent C is decreased, and when the toner 101 reaches a point B, the toner 101 is fully mixed with the two-component developing agent C.

In the current embodiment, the time when the toner 101 is newly supplied to the toner supply position in FIG. 11, reaches the point B, and is fully mixed with the carrier is referred to as time T for mixture and agitation. As illustrated in FIG. 10, when the amount of developing agent in the developing unit 18 is set to be small, about 200 g, like n conditions 2 and 3 according to the current embodiment, the time T2 is further decreased. Thus, the value of the time T for mixture and agitation needs to be sufficiently decreased. For example, in the case of condition 2, the time T for mixture and agitation needs to be 2.1 seconds, and in the case of condition 3, the time T for mixture and agitation needs to be 2.7 seconds. Thus, in order to satisfy conditions 2 and 3 that are high-speed process conditions, the toner 101 needs to be mixed with the carrier in a shorter time and the time T for mixture and agitation needs to be as small as possible.

Thus, it may be known from the result of FIG. 9 that the desired amount W of transferring the developing agent is obtained by disposing the agitation screw 32 that has a large diameter and by making the pitch P large and simultaneously, the time T for mixture and agitation needs to be limited to the minimum. In this regard, a relationship exists between the time T for mixture and agitation, the value r illustrated in FIG. 4, the number of revolutions R of the screw, and the pitch P of the screw.

$$T>\alpha\cdot P/(r\cdot R) \qquad \text{Equation 4}$$

In other words, the time T for mixture and agitation decreases as r increases. In addition, the value of the time T for mixture and agitation decreases as R increases. In addition, the value of the time T for mixture and agitation decreases as the pitch P of the screw decreases.

Figure 15:
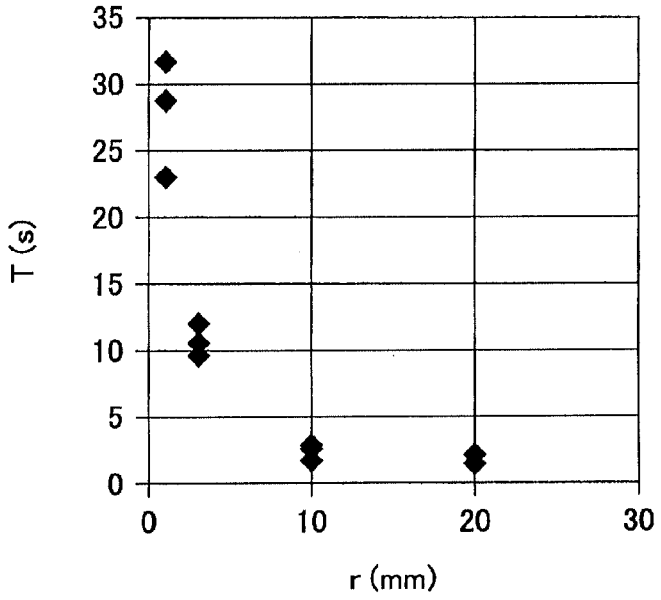
FIG. 15 is a graph showing an empirical result of the relationship between r and T when the number of revolutions R is 500 revolutions per minute (rpm) and a pitch P of the screw is 15 mm.
Figure 16:
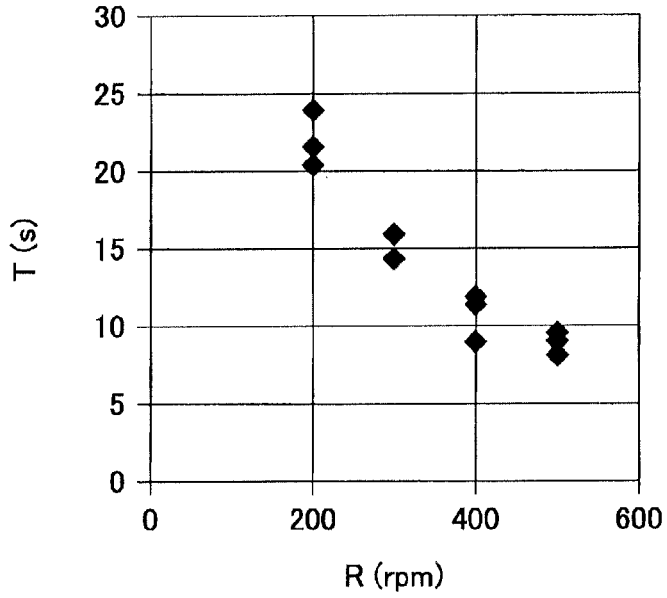
FIG. 16 is a graph showing an empirical result of the relationship between R and T when r is 3 mm and P is 15 mm.
Figure 17:
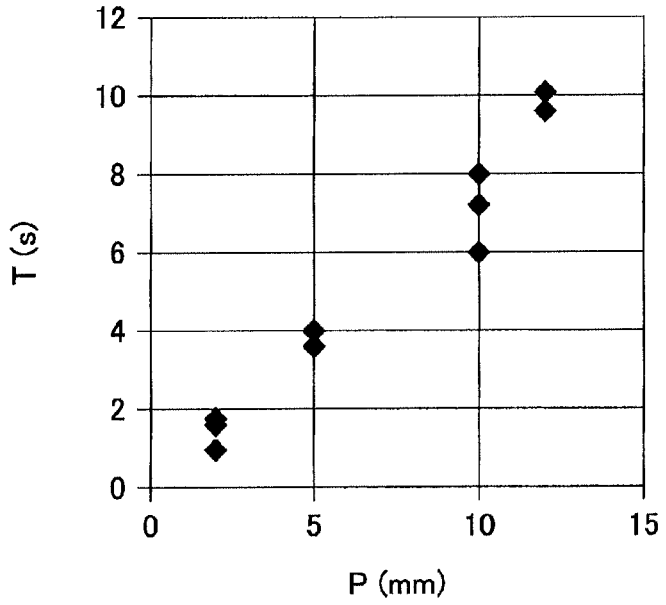
FIG. 17 is a graph showing an empirical result of the relationship between P and T when the number of revolutions R is 500 rpm and r is 3 mm.

FIG. 15 is a graph showing an empirical result of the relationship between r and T when the number of revolutions R is 500 revolutions per minute (rpm) and a pitch P of the screw is 15 mm, and FIG. 16 is a graph showing an empirical result of the relationship between R and T when r is 3 mm and P is 15 mm, and FIG. 17 is a graph showing an empirical result of the relationship between P and T when the number of revolutions R is 500 rpm and r is 3 mm.

In this case, the grounds for establishing Equation 4 will now be described with reference to FIGS. 15 through 17. First, the relationship between r and T was established by experiments when R=500 rpm and P=15 mm by using an actual device, and thus, the empirical result was obtained as illustrated in FIG. 15. From the result of FIG. 15, that the time T decreases as r increases is proven.

In addition, the relationship between R and T when r=3 mm and P=15 mm was established by experiments, and thus, the empirical result was obtained as illustrated in FIG. 16. The result of FIG. 16 proves that the time T decreases as R increases.

In addition, the relationship between P and T when R=500 rpm and r=3 mm was established by experiments, and thus, the empirical result was obtained as illustrated in FIG. 17. The result of FIG. 17 proves that the time T increases as P increases, thus, proving that Equation 4 was established by using a constant α.

Figure 12:
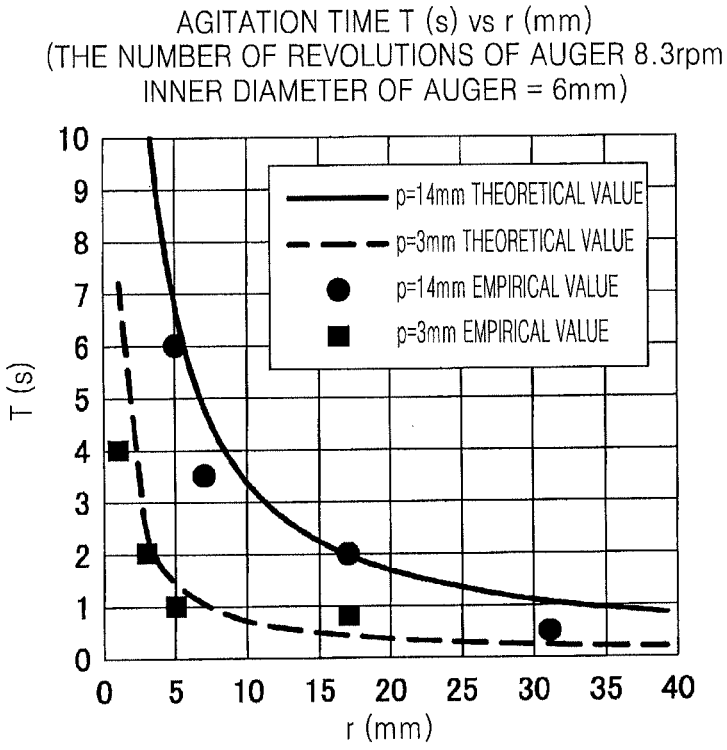
FIG. 12 is a graph showing the relationship between the time T for mixture and agitation and a value r illustrated in FIG. 4.

Referring to FIG. 9, when the agitation screw 32 that has a large outer diameter of about 40 mm is used in the preparatory agitation unit 30, the pitch P of the agitation screw 32 is about 3 mm (W=37 g/s). FIG. 12 is a graph showing the relationship between the time T for mixture and agitation and a value r illustrated in FIG. 4. FIG. 12 shows a theoretical value and an empirical value (actually-measured value) when the outer diameter D of the agitation screw 32 is 40 mm and the pitch P of the screw is 14 mm, and a theoretical value and an empirical value when the pitch P is 3 mm. Here, the theoretical values represent Equation 4, and FIG. 12 is a characteristic graph showing the relationship between r and T when an inequality sign of Equation 4 is changed into an equality sign. In addition, the empirical values are obtained by using the agitation screw 32, having an outer diameter of 40 mm, by changing the value r, and by measuring the time T for mixture and agitation. In addition, the time T for mixture and agitation may be obtained by measuring the time when a sensor (a device for measuring distribution of the charging amount) for measuring distribution of charges of the toner is disposed in an arbitrary position of a transferring path and the toner reaches the closest point to the toner supply position where a toner charged to a positive potential does not exist (point B in FIG. 11). In this manner, by obtaining the relationship between r and T, the theoretical values and the empirical values in FIG. 12 are obtained, and from the result of FIG. 12, that a constant α in Equation 4 is 20 is proven.

It may be known from the result of FIG. 12 that, when the pitch P is 3 mm, the value r is equal to or greater than 3 mm to decrease the time T for mixture and agitation up to 2 seconds, as illustrated in FIG. 10.

In this way, the relationship between r and T in the preparatory agitation unit 30 satisfies Equation 4 so that conditions for mixture and agitation are satisfied, and all the toner that has been received from the preparatory agitation unit 30 and transferred in the direction A3 in FIG. 3 and has reached the end part 20*a* of the first transferring screw 20 is charged to a negative potential. Thus, by modifying Equation 4, the relationship between r and T required when the preparatory agitation unit 30 that has a large diameter is installed may be expressed as Equation 5.

$$r>\alpha\cdot P/(R\cdot T) \qquad \text{Equation 5}$$

For example, when the outer diameter D of the preparatory agitation unit 30 is 40 mm, an inner diameter of the preparatory agitation unit 30 is 6 mm, and the number of revolutions R of the agitation screw 32 is 500 rpm (8.3 rps), it may be known from the result of FIG. 9 that the pitch P of the agitation screw 32 is about 3 mm (condition 3; in the case of W=37 g/s). In this case, when r is 7 mm, the time T for mixture and agitation is about 1 second, according to Equations 4 and 5.

Thus, when the agitation screw 32 that has a large diameter is installed, the preparatory agitation unit 30 and the agitation screw 32 are configured to satisfy Equation 5 and to obtain a required value r so that the time T for mixture and agitation may be set to a desired time.

Figure 13:
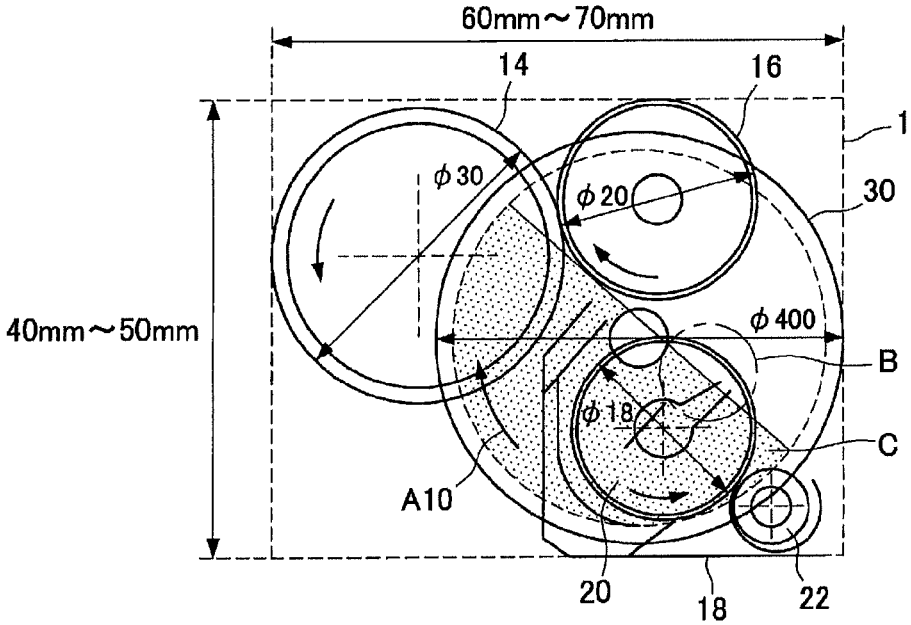
FIG. 13 is a view of a structure in which a diameter of a photosensitive drum is ϕ30, a diameter of a developing roller is ϕ20 and a diameter of a first receiving or transferring screw is ϕ18.

Next, a specific application example of the preparatory agitation unit 30, according to the current embodiment, will be described. FIG. 13 is a view of a structure in which a diameter of the photosensitive drum 14 is ϕ30, a diameter of the developing roller 16 is ϕ20, a diameter of the first transferring screw 20 is ϕ18, and a function of agitating the toner and the carrier in the developing unit 18 is performed only by the preparatory agitation unit 30. By satisfying Equation 5, the toner and the carrier are fully mixed by the preparatory agitation unit 30 and are supplied to the position of the end part 20*a* of the first transferring screw 20. Thus, the first and second transferring screws 20 and 22 may have only a function of transferring the two-component developing agent C in which mixture of the toner and the carrier has been completed. Thus, because the first and second transferring screws 20 and 22 do not need to have an agitation function and have only the function of transferring the two-component developing agent C, the outer diameters of the first and second transferring screws 20 and 22 may be greatly reduced and the size of a processing unit illustrated in FIG. 13 may be greatly reduced. In the arrangement of FIG. 13, a width of the processing unit may be reduced to about 60 to 70 mm, and a height thereof may be reduced to about 40 to 50 mm. Thus, a cross-sectional area of the processing unit having the structure of FIG. 13 may be greatly reduced (in FIG. 13, being equal to or less than 3500 $mm^2$), and in the case of a color printer that may print colors, a process pitch between processing units having different colors and that are adjacent each other may be reduced. In FIG. 13, because right and left widths of the processing unit are approximately 70 mm (maximum) the process pitch may be limited to be less than approximately 70 mm.

In addition, when the outer diameter of the photosensitive drum 14 is equal to or less than 30 mm in FIG. 3, if the cross-sectional area of the preparatory agitation unit 30 is S1 [$mm^2$], the cross-sectional area of the photosensitive drum 14 is S2 [$mm^2$], the cross-sectional area of the developing roller 16 is S3 [$mm^2$], and the cross-sectional area of the first receiving or transferring screw 20 is S4 [$mm^2$], as defined in Equation 6.

$$S1<S2+S3+S4 \qquad \text{Equation 6}$$

In addition, in FIG. 13, a position in which the developing agent is transferred from the preparatory agitation unit 30 to the first transferring screw 20 is set in consideration of the flow of the developing agent according to a rotation direction of the agitation screw 32 of the preparatory agitation unit 30.

As illustrated in FIG. 13, when the agitation screw 32 of the preparatory agitation unit 30 is rotated in a direction A10, the two-component developing agent C that is indicated by a dotted region in FIG. 13 is inclined towards the surface of the preparatory agitation unit 30 as the agitation screw 32 is rotated. Thus, a transferring path in which the preparatory agitation unit 30 and a transferring chamber including the first transferring screw 20 communicate with each other, is installed in a region indicated by an alternate long and short dash line B in FIG. 13. Thus, the developing agent may be, prevented from being fully filled in the transferring path, and an air gap may be formed in the transferring path, and the two-component developing agent C may be efficiently moved to the first transferring screw 20.

Figure 14:
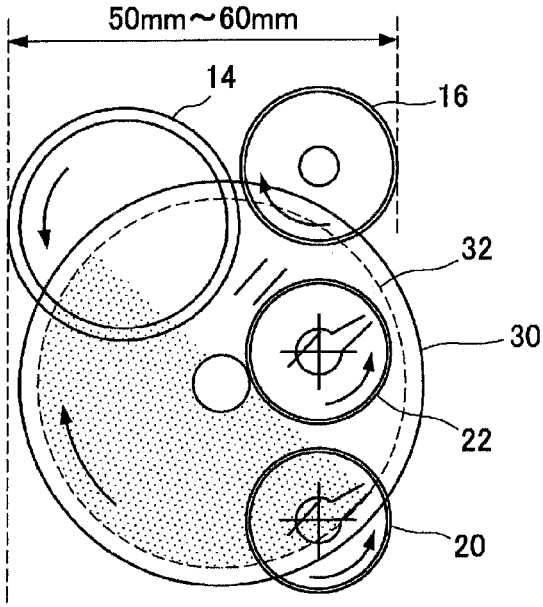
FIG. 14 is a view of an example of a process pitch that is minimized by using a preparatory agitation unit that has a large diameter.

FIG. 14 is a view of an example of a process pitch that is minimized by using the preparatory agitation unit 30 that has a large diameter.

As illustrated in FIG. 14, the first transferring screw 20 is disposed under the second transferring screw 22 so that the process pitch may be reduced compared to the structure of FIG. 13. In this case, the process pitch may be reduced to about 50 to 60 mm.

While this disclosure has been particularly shown and described with reference to exemplary embodiments thereof, it will be understood by those skilled in the art that various changes in form and details may be made therein without departing from the spirit and scope of the disclosure as defined by the appended claims. The exemplary embodiments should be considered in descriptive sense only and not for purposes of limitation. Therefore, the scope of the disclosure is defined not by the detailed description of the disclosure but by the appended claims, and all differences within the scope will be construed as being included in the present disclosure.

What is claimed is:

1. An image forming apparatus, the apparatus comprising:

a photosensitive drum to transfer a toner supplied according to an electrostatic latent image onto a printing medium, and to form an image on the printing medium;

a developing roller to supply the toner to the photosensitive drum; and a developing unit to supply, to the developing roller, a two-component developing agent, in which the toner and a carrier are mixed, wherein the developing unit comprises:

a transferring unit to transfer the two-component developing agent in an axial direction of the developing roller; and a preparatory agitation unit disposed on an end part of the transferring unit and comprising an agitation screw that has a large diameter, and to mix the newly-supplied toner and the carrier, and when a process speed at which the photosensitive drum forms an image on the printing medium is approximately 300 mm/s, a width of the printing medium at which the photosensitive drum forms an image is equal to or less than approximately 216 mm, and if an amount at which the agitation screw protrudes from a surface of the two-component developing agent in an upward direction is r (mm), a pitch of the agitation screw is P (mm), a number of revolutions of the agitation screw is R (rps), and time for mixture and agitation is T (s), then the preparatory agitation unit satisfies the following inequality:

$$r > 20\frac{P}{RT}.$$

2. The image forming apparatus of claim 1, wherein, when an outer diameter of the photosensitive drum is equal to or less than approximately 30 mm, a cross-sectional area of the preparatory agitation unit is S1 ($mm^2$), a cross-sectional area of the photosensitive drum is S2 ($mm^2$), a cross-sectional area of the developing roller is S3 ($mm^2$), and a cross-sectional area of a transferring screw of the transferring unit is S4 ($mm^2$), the following inequality is satisfied:

$$S1 < S2 + S3 + S4.$$

3. The image forming apparatus of claim 1, wherein an outer diameter of the photosensitive drum is equal to or less than approximately 30 mm, and a cross-sectional area of a cross-section that is perpendicular to an axis of the photosensitive drum of a processing unit comprising the photosensitive drum, the developing roller, and the developing unit is equal to or less than approximately 3500 $mm^2$.

4. The image forming apparatus of claim 1, wherein an outer diameter of the photosensitive drum is equal to or less than approximately 30 mm, and a width of a cross-section that is perpendicular to an axis of the photosensitive drum of a processing unit comprising the photosensitive drum, the developing roller, and the developing unit is equal to or less than approximately 70 mm.

5. The image forming apparatus of claim 1, wherein the developing unit further comprises a permeability sensor to adjust an amount of toner supply to the developing unit so that a weight percentage of the toner with respect to a total weight of the two-component developing agent has a predetermined value.

6. The image forming apparatus of claim 1, wherein the two-component developing agent is moved in an axial direction of the developing roller by a first transferring screw in the developing unit, and is attached to the surface of the developing roller by a magnetic force of the developing roller.

7. The image forming apparatus of claim 1, wherein the preparatory agitation unit has a larger diameter than the those of the photosensitive drum, the developing roller, a first transferring screw, and a second transferring screw, so that newly-supplied toner is fully mixed with the carrier and charged to a predetermined potential.

* * * * *